US006065442A

United States Patent [19]

Motose et al.

[11] Patent Number: 6,065,442

[45] Date of Patent: May 23, 2000

[54] START-UP STRATEGY FOR ENGINE FEED BACK CONTROL

[75] Inventors: Hitoshi Motose; Masahiko Kato, both of Hamamatsu, Japan

[73] Assignee: Sanshin Kogyo Kabushiki Kaisha, Hamamatsu, Japan

[21] Appl. No.: 09/209,537

[22] Filed: Dec. 11, 1998

[30] Foreign Application Priority Data

Dec. 16, 1997 [JP] Japan ..... 9-346341

[51] Int. Cl.[7] ..... F02D 41/06; F02D 41/14

[52] U.S. Cl. ..... 123/294; 123/73 C; 123/673; 123/686

[58] Field of Search ..... 123/73 C, 294, 123/305, 491, 685, 686, 673

[56] References Cited

U.S. PATENT DOCUMENTS

| | | | |
|---|---|---|---|
| 5,522,370 | 6/1996 | Katoh et al. | 123/685 |
| 5,632,260 | 5/1997 | Kato | 123/673 |
| 5,673,676 | 10/1997 | Mukumoto | 123/673 |

*Primary Examiner*—Tony M. Argenbright
*Attorney, Agent, or Firm*—Knobbe, Martens, Olson & Bear LLP

[57] ABSTRACT

A start-up strategy for engine feedback control that utilizes a combustion condition sensor associated with only one cylinder. On starting and warm-up, only that one cylinder is feedback-controlled at all times. Under these conditions, the amount of corrected fuel supplied to the feedback cylinder is added to a fixed incremental amount of fuel that will be supplied to the remaining cylinders. This promotes smooth warm-up without backfiring or stalling and a quicker transition to all cylinder feedback control.

26 Claims, 8 Drawing Sheets

START-UP STRATEGY FOR ENGINE FEED BACK CONTROL

BACKGROUND OF THE INVENTION

This invention relates to an engine control strategy for a direct injected engine and more particularly to an improved start-up strategy for an engine having a feedback fuel injection control.

In the interest of improving engine performance and particularly fuel efficiency and exhaust emission control, many types of engines now employ fuel injection and/or feedback control of the fuel supply to the engine. Fuel injection has the advantages of permitting the amount of fuel delivered for each cycle of the engine to be adjusted. In addition, by utilizing fuel injection and a feedback control system, it is possible to maintain the desired fuel air ratio under a wide variety of engine running condition.

These features are particularly useful with two cycle engines, although not specifically limited thereto. The utilization of these features with two cycle engines is important, however, because of the emission characteristics of the two cycle engine is somewhat poorer than those of the four cycle engine. This is the result of the fact that the engine fires every revolution and there is a fairly substantial overlap during the scavenging and exhaust cycles.

Generally, these systems operate with a combustion condition sensor such as an oxygen ($O_2$) sensor that outputs a signal indicating whether the mixture is lean or rich. If the mixture deviates from the desired mixture, then incremental adjustments may be made to bring the mixture back into the desired relationship.

It is also acknowledged that the oxygen sensors or combustion conditioned sensors normally utilized must be at a certain temperature in order to provide a proper output. Therefore, start-up and warm-up conditions are conditions that are difficult to operate under feedback control. Various devices and methodologies have been employed for utilizing other control strategies during starting and warm-up. However, these strategies have some disadvantages and may require operation under a non-feedback control condition for longer than necessary.

It is, therefore, a principal object of this invention to provide an improved engine feedback control system and particularly a start-up and warm-up operation for such system.

It is a further object of this invention to provide an engine feedback control system that has an arrangement wherein feedback control of at least one cylinder is provided during starting and warm-up with the other cylinders have their injection amount based upon the correction made to the fed back cylinder with adjustments being made to compensate for the fact that the sensor output may not be totally reliable under these conditions.

SUMMARY OF THE INVENTION

This invention is adapted to be embodied in an internal combustion engine having at least two combustion chambers, each of which is provided with an induction system for delivering an air charge to the combustion chambers and an exhaust system for discharging the burnt charge from the combustion chambers. A fuel injector is provided for each combustion chamber which injects fuel into the air supplied by the induction system for burning in the respective combustion chamber. A combustion condition sensor is associated with one of the combustion chambers and not for another to provide a signal indicative of the air fuel ratio in that one combustion chamber. A feedback control system controls the amount of fuel supplied by the fuel injectors to the respective combustion chamber.

In accordance with a method for practicing the invention, at least one of a starting and warm-up condition for the engine is sensed. When this condition is sensed, feedback control is provided only for the combustion chamber with which the combustion condition sensor is associated. The amount of fuel supplied to the other combustion chamber by its fuel injector is controlled by adding a fixed incremental value of fuel to the adjusted amount of fuel injected to the feedback controlled combustion chamber.

In accordance with an engine that practices the invention, means are provided for sensing when the engine is in one of a starting or warm-up condition. When that condition is sensed, only the combustion chamber with which the combustion condition sensor is operated in a feedback control mode. Fuel is supplied to the other fuel injector by the control based upon the adjusted amount of fuel supplied to the combustion chamber which is feedback-controlled, plus a fixed incremental additional amount of fuel.

DETAILED DESCRIPTION OF THE PREFERRED EMBODIMENTS OF THE INVENTION

Figure 1:
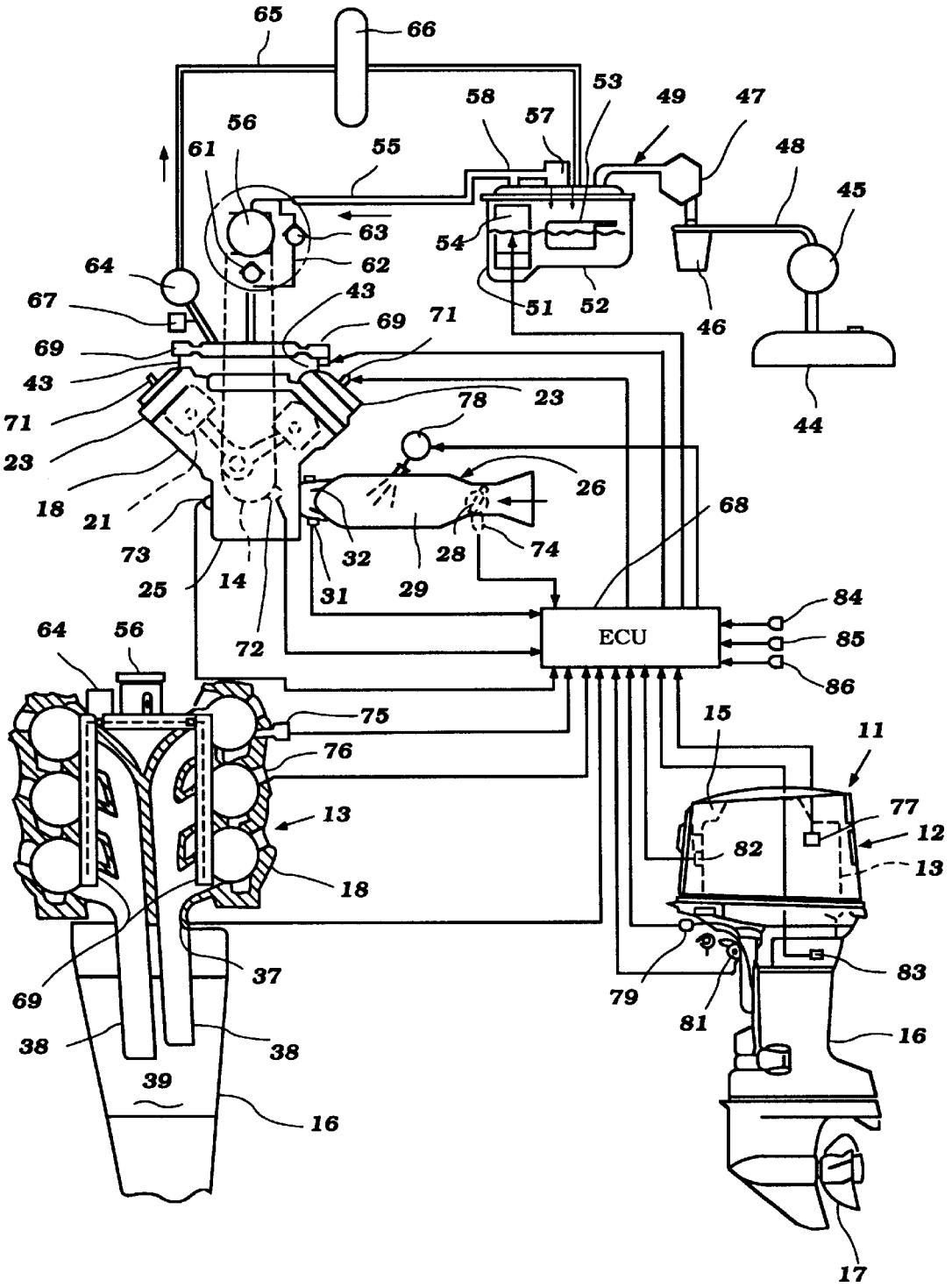
FIG. 1 is a partially schematic view having three portions that are connected by the controlling ECU of the engine. The lower right hand portion of this view shows a side elevational view of an outboard motor, the lower left hand side shows a rear elevational view of the outboard motor on an enlarged scale and a partial cross-section of the engine taken through the cylinders and exhaust manifold and the upper portion shows a top plan view of the engine and the fuel supply system with portions shown schematically.

Referring initially primarily to FIG. 1, the lower right hand portion of this view illustrates a side elevational of an outboard motor that is constructed and operated in accordance with the invention. The outboard motor is indicated generally by the reference numeral 11 and except as will hereinafter be noted maybe considered to be of a generally conventional construction.

Figure 11:
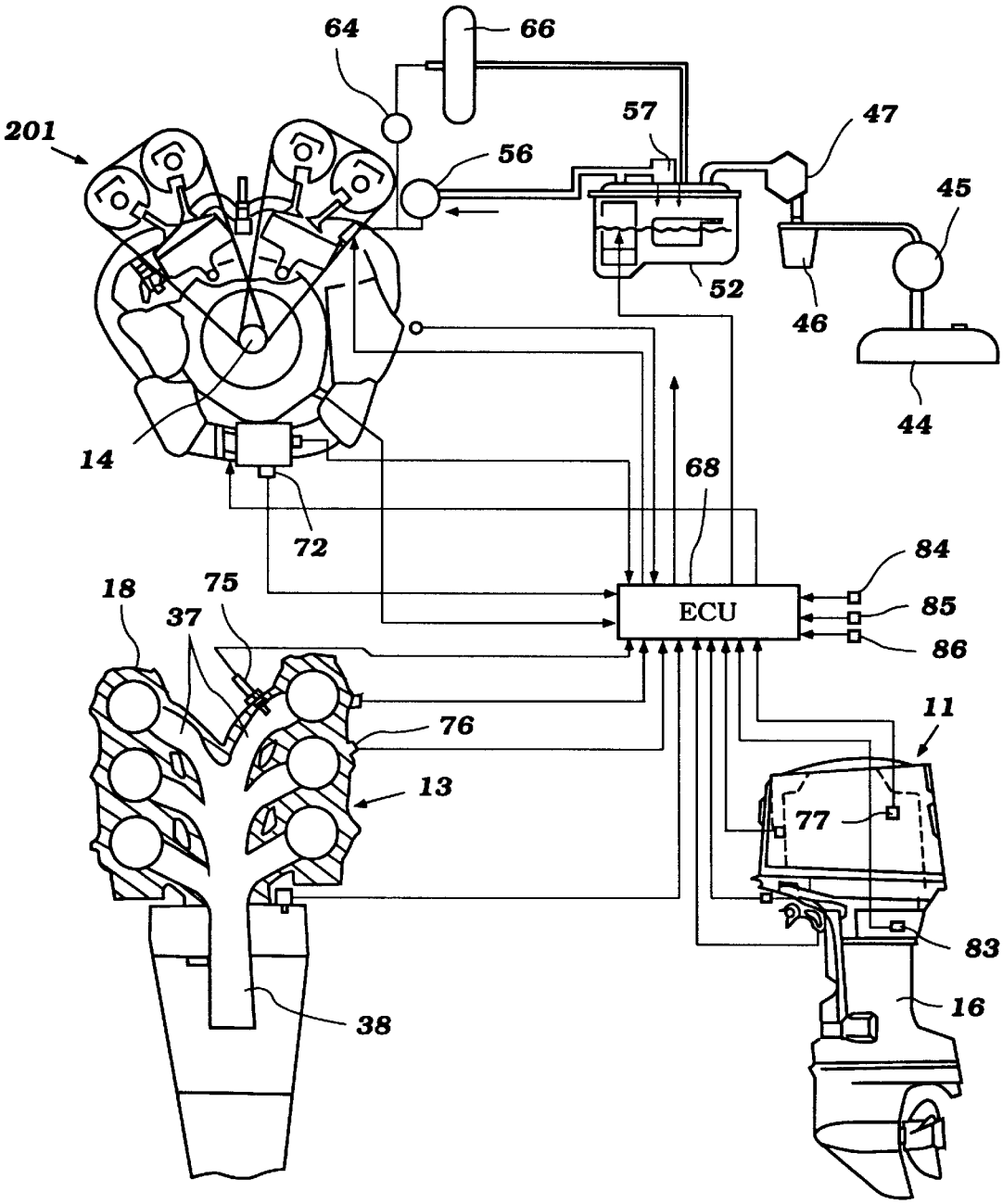
FIG. 11 is a view, in part similar to FIG. 1, and shows a four-cycle engine constructed in accordance with an embodiment of the invention.

The outboard motor 11 is comprised of a power head 12 that contains a powering internal combustion engine 13. As best seen in the other two portions of this figure, the engine 13 is, in this embodiment, of the V6 type and operates on a two stroke crankcase compression principle. Although the number of cylinders and cylinder orientation can be varied, the invention has particularly utility in connection with two cycle engines and particularly those having multiple cylinders but certain of the control strategy also is applicable to four cycle engines. Such an embodiment is shown in FIG. 11.

As is typical with outboard motor practice, the engine 13 is supported in the power head 12 so that its crankshaft 14 rotates about a vertically extending axis for a reason which will be described momentarily.

The power head 12 is completed by a protective cowling 15 which surrounds and protects the engine 13. This protective cowling 15 is formed with an air inlet opening so that induction air for operation for the engine 13 can be drawn from the surrounding atmosphere.

The engine 13 and specifically its crankshaft 14 is coupled to a driveshaft (not shown) that depends into and is journaled within a driveshaft housing lower unit assembly 16. This is the reason for the vertical orientation of the axis of rotation of the crankshaft 14. This driveshaft depends into the lower unit where it drives a propulsion device for an associated watercraft through a suitable transmission. In the illustrated embodiment, the propulsion device comprises a propeller 17 which is selectively driven in forward and reversed directions through a bevel gear reversing transmission of the type well known in this art.

The outboard motor 11 also includes clamping and swivel brackets or another arrangement for mounting it to the transom of an associated watercraft. Since these types of constructions are well known in the art, further description of them is not believed to be necessary to permit those skilled in the art to practice the invention. The mounting arrangement is such, however, that the height and trim angle of the propeller 17 may be adjusted, even during running. This is significant in the engine control, as will become apparent.

Figure 2:
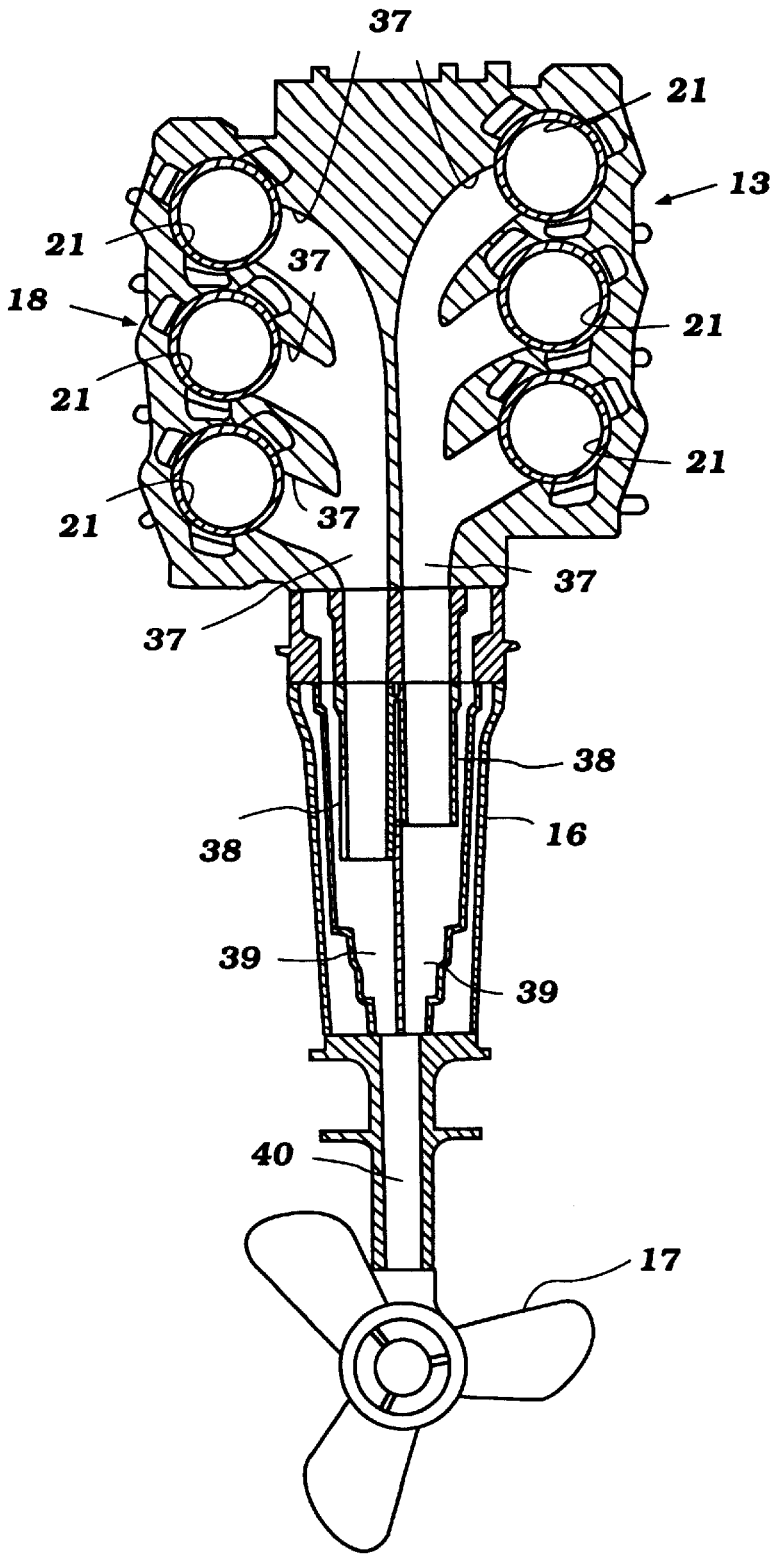
FIG. 2 is an enlarged and more complete view of the outboard motor as shown in the lower left hand view of FIG. 1.

Referring now primarily to the lower left hand view and the upper view of FIG. 1 and additionally to FIG. 2, the engine 13 includes a cylinder block, indicated generally by the reference numeral 18. Because of the V-type configuration employed in this embodiment, the cylinder block 18 is formed with two cylinder banks each of which has three vertically spaced cylinder bores 19. Pistons 21 are slidably supported in the cylinder bores 19. The pistons 21 are connected by means of connecting rods 22 to the throws of the crankshaft 14 for driving it in a known manner.

Cylinder head assemblies, indicated generally by the reference numeral 23 are affixed to the banks of the cylinder block 18 and close the cylinder bores 21. These cylinder head assemblies 22, the cylinder bores 19 and the pistons 21 form the combustion chambers of the engine 13.

The crankshaft 14 rotates in a crankcase chamber defined by the cylinder block 18 and a crankcase member 24 that is affixed thereto. As is typical with two cycle crankcase compression engines, the portions of the crankcase chamber, indicated schematically at 25, associated with each of the cylinder bores 19 are sealed from each other.

An air charge is delivered to these individual crankcase chamber sections 25 by an air induction system which appears also in the upper portion of FIG. 1 and which is indicated generally by the reference numeral 26. This induction system 26 includes an air inlet device 27 that may include a silencing arrangement and which draws air from within the protective cowling 15 that has been admitted through the aforenoted inlet opening.

A throttle valve 28 is provided in throttle bodies that communicate with the intake device 27 and deliver it to intake manifold runners 29 of an intake manifold assembly. The throttle valves 28 are controlled in any suitable manner to satisfy the operator demand. The intake manifold runners 29 communicate with intake ports 31 formed in the crankcase member 24 and each associated with a respective cylinder bore 19.

Reed type check valves 32 are provided in the manifold runners 29 adjacent the intake ports 31. These reed type check valves permit an air charge to be drawn into the crankcase chambers when the respective pistons 21 are moving upwardly in their cylinder bores 19. As the pistons 21 move downwardly, the charge in the crankcase chambers 25 will be compressed and the respective reed type check valve 32 will close to preclude reverse flow.

Figure 3:
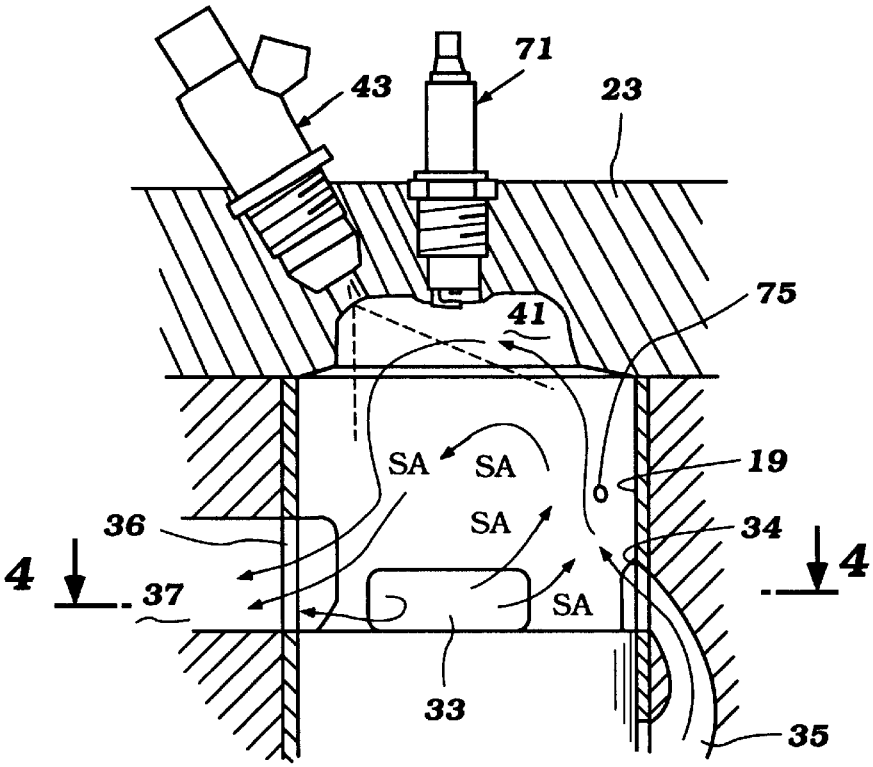
FIG. 3 is an enlarged cross-sectional view taken through a single cylinder of the engine and depicts part of the theory by which the control strategy operates.
Figure 4:
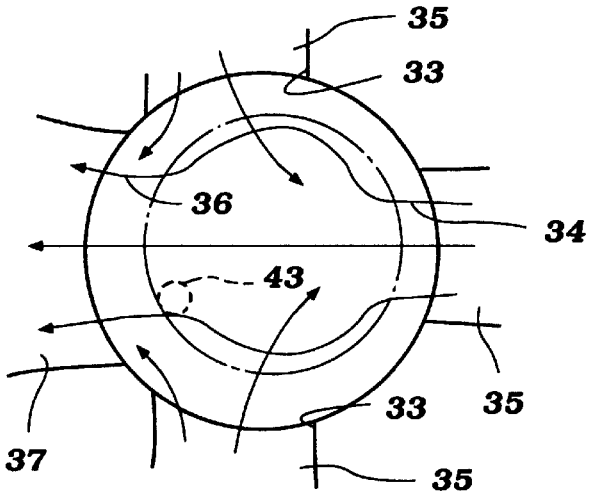
FIG. 4 is a cross-sectional view taken along the line 4—4 in FIG. 3 to further show the scavenging air flow pattern and the path of injected fuel.

Referring now additionally to FIGS. 3 and 4, it will be seen that each cylinder bore is provided with a scavenging system. In the illustrated embodiment, the scavenging system is of the Schnurl type and includes a pair of side, main scavenge ports 33 and a center, auxiliary scavenge port 34. Scavenge passages 35 communicate the crankcase chambers 25 with each of the scavenge ports 34 and 35. As is well known in two cycle practice, the scavenge ports 33 and 34 are opened and closed by the reciprocation of the pistons 21 in the cylinder bores 19.

It should be noted that the main scavenge ports 33 are disposed on opposite sides of an exhaust port 36 which is diametrically opposite the auxiliary scavenge port 34. As may be best seen in the lower left hand portion of FIG. 1 and in FIG. 2, the exhaust ports 36 communicate with exhaust manifolds 37 that are formed integrally within the cylinder block 18. Basically, there is an exhaust manifold 37 for each bank of cylinders.

These exhaust manifolds 37 terminate in exhaust pipes 38 that depend into a pair of expansion chambers 39 formed in the driveshaft housing and lower unit 16. These expansion chambers 39 communicate with a suitable high speed underwater exhaust gas discharge and a low speed, above the water exhaust gas discharge of any known type.

The underwater exhaust gas discharge is shown primarily in FIG. 2 and includes a conduit 40 that depends through the lower unit portion of the drive shaft housing lower unit and which communicates through the hub underwater discharge formed in the propeller 17.

As has been previously noted, the trim and height of the propeller 17 can be adjusted and this adjustment will change the depth of submersion of the underwater discharge during engine running. In addition, various water conditions may also cause this height to vary during engine running. Thus, the back pressure on the exhaust system will be variable and this back pressure is particularly significant in effecting the rate of air flow in scavenging the combustion chambers of the engine. Thus, a condition is present with marine applications that is not existent normally in automotive applications and which can seriously effect the feedback control, as will be described shortly.

As the pistons 21 move downwardly in their cylinder bores 19 toward the bottom dead center position shown in FIG. 4, the charge compressed in the crankcase chambers 25 will be compressed and eventually transfer to the respective engine combustion chamber, indicated generally by the reference numeral 41 through the scavenge passages 35 and scavenge ports 33 and 34 when they are opened by the movement of the piston 21. The flow of scavenging air is shown in FIGS. 2 and 3 by the arrows SA.

In accordance with an important feature of the invention, the engine 13 is provided with a direct cylinder fuel injection system. This fuel injection system is shown in part schematically in the upper portion of FIG. 1 and will now be described by particular reference to that figure. Before referring thereto, however, it should be noted that fuel injectors 42 are mounted in the cylinder head assembly 23 so as to spray fuel from this fuel supply system directly into the combustion chambers 41. The location and functioning of these fuel injectors 43 will be described after the system which supplies fuel to them has been described.

As is typical with outboard motor practice, the outboard motor 11 is supplied with fuel from a main fuel tank 44 which is normally mounted within the hull of the associated watercraft. Fuel is supplied form this tank 44 by a first low pressure pump 45 to a fuel filter 46 that is mounted within the protective cowling 12. The connection from the fuel tank 44 to the filter 46 includes a conduit 47 having a quick disconnect coupling of a known type.

A second, engine driven low pressure fuel pump 47 in the power head 12 collects the fuel from the fuel filter 46 and delivers it to a vapor separator, indicated generally by the reference numeral 49. The low pressure fuel pumps 48 may be of the type that are operated by crankcase pressure variations as is well known in this art.

The vapor separator 49 includes an outer housing 51 that is mounted at a suitable location within the protective cowling 15. A level of fuel, indicated at 52 is maintained in this housing 51 by a valve operated by a float 53.

Contained within the housing 51 is an electrically driven pressure pump 54 which develops a higher pressure than the pump 47 but a pressure that is not really high enough for effective high pressure direct cylinder injection.

This fuel is discharged from the vapor separator housing 51 through a supply conduit 55 to a high pressure, engine driven, positive displacement pump 56. The pump 56 may be of any known type and preferably has one or more plungers operated by cams for delivering extremely high pressures at a positive displacement. The pressure at which fuel is delivered to the high pressure pump 56 is regulated by a low pressure regulator 57 in a return line 58 that communicates the pressure line 55 back with the interior of the vapor separator body 51.

The high pressure pump 56 delivers fuel under pressure to a main fuel manifold 59 through a conduit in which a check valve 61 is positioned. A parallel conduit 62 extends around the high pressure pump 56 to the main fuel manifold. A check valve 63 is provided in this bypass line so that when the high pressure pump 56 is generating high pressure fluid, no flow will occur through the line 62.

A high pressure regulator 64 is provided in the main fuel manifold 59 and limits the maximum pressure of the fuel supply to the fuel injectors 43. This is done by dumping fuel back to the vapor separator assembly 49 through a return line 65. A fuel heat exchanger or cooler 66 may be provided in this return line 65 so as to ensure that the fuel is not at too high a temperature.

A pressure sensing device 67 is provided also in the main fuel manifold 59 for providing a fuel pressure signal to an ECU, indicated at 68 in FIG. 1 for controlling the engine systems, as will be described.

The main fuel manifold 59 supplies fuel to a pair of fuel rails 69 each of which is associated with a respective one of the cylinder banks. The fuel rails 69 each supply fuel in a known manner to the fuel injectors 43 of the respective cylinder banks.

As seen in FIGS. 3 and 4, the fuel injectors 43 are mounted in the cylinder head assemblies 23, in the illustrated embodiment, over the exhaust ports 36 on the exhaust side of the engine. These injectors spray downwardly toward the heads of the pistons 21. The fuel injectors 43 are preferably of the solenoid operated type and have a solenoid valve which, when opened, controls the discharge of fuel into the combustion chambers as shown in broken lines in FIG. 3 so as to provide a fuel patch in the combustion chamber, the size of which depends upon the duration of fuel injection as will become apparent.

Spark plugs 71 are mounted in the cylinder head assemblies 23 and have their spark gaps disposed substantially on the axis of the cylinder bores 19. These spark plugs 71 are fired by an ignition circuit under the control of the ECU 68.

The ECU 68 controls the timing of firing of the spark plugs 71 and the beginning and duration of fuel injection by the injector 69. To this end, there is provided a number of sensors which sense either engine running conditions, ambient conditions or conditions of the outboard motor 11 that will effect engine performance. Certain of the sensors are shown schematically in FIG. 1 and will be described by reference to that figure. It should be readily apparent to those skilled in the art, however, that other types of sensing and control arrangements may be provided operating within the general parameters which will be set forth later having to do with the timing of initiation of fuel injection.

A crank angle sensor 72 is associated with the crankshaft 14. This sensor 72 provides not only a signal of crank angle but by comparing that signal with time an indication of crankshaft rotational speed.

There is also provided a crankcase pressure sensor 73 which senses the pressure in one or all of the crankcase chambers 25. By measuring crankcase pressure at a particular crank angle, engine air induction amount can be determined.

Engine or operator demand is determined by a throttle position sensor 74 that operates in conjunction with a throttle valve 28 so as to determine this function.

The ECU 68 may operate on a feedback control condition and thus, an air fuel ratio sensor 75 is provided that communicates with the combustion chambers or exhaust port of at least one of the cylinder. Preferably, an oxygen sensor is utilized for this purpose, although other types of devices may be employed.

In order to provide a good indication of the fuel/air ratio, it is important that the oxygen sensor 75 is positioned so that it will sense the combustion products near the completion of combustion and before a fresh charge of air is delivered to the combustion chamber. Therefore, and as best shown in FIG. 3, the oxygen sensor 75 is provided so that its probe opens into the cylinder bore 19 at a point that is disposed slightly vertically above the upper edge of the exhaust port 36. In this way, the oxygen sensor 75 will be in a position to receive combustion products immediately before opening of the exhaust port and most positively before the opening of the scavenge ports so that it will sense the combustion products at the time combustion has been substantially completed.

Engine temperature is sensed by a engine temperature sensor 76.

The temperature of the cooling water drawn from the body of water in which the watercraft or outboard motor 11 is operated is measured by a water temperature sensor 77. As has been noted, those sensors described may be just typical of any of the wide variety of sensors utilized for engine control.

In addition to controlling timing of firing of the spark plugs 71 and initiation and duration of fuel injection by the fuel injectors 43, the ECU 68 may also control a lubricating system. This is comprised of an oil supply system including a pump 78 that sprays oil into the intake passages 29 for engine lubrication. In addition, some forms of direct lubrication may be also employed for delivering lubricant directly to certain components of the engine.

It has already been noted that the adjustment of the angle of the propeller 17 will change the vertical position of its high-speed exhaust discharge and accordingly the back pressure. Thus, there are provided additional sensors which sense factors that will indicate this depth. These comprise an engine height sensor 79 that is mounted on the outboard motor 11 and which senses its height adjustment. Also, a trim angle sensor 81 is provided which senses the adjusted trim angle.

Other sensors may also be employed for control and some of these are associated with the engine 13 or the outboard motor 11 itself. These may include an engine vibration or knock sensor 82 and a neutral sensor 83. The neutral sensor 83 cooperates with the aforenoted forward, neutral, reverse transmission and will provide an indication of when the watercraft is operating in neutral.

Also shown schematically in FIG. 1 is a watercraft speed sensor 84 and a watercraft pitch sensor 85 that will sense the condition of the watercraft relative to the body of water and again indirectly the back pressure in the exhaust system. Finally, there is provided an atmospheric pressure sensor 86. Of course, the sensors described are only typical of those types of sensors which may be employed for the feedback control system, as will become apparent.

The components of the system as thus far described may be considered to be conventional and for that reason, where any component has not been illustrated or described in detail, reference may be had to conventional or known structures with which to practice the invention.

Figure 5:
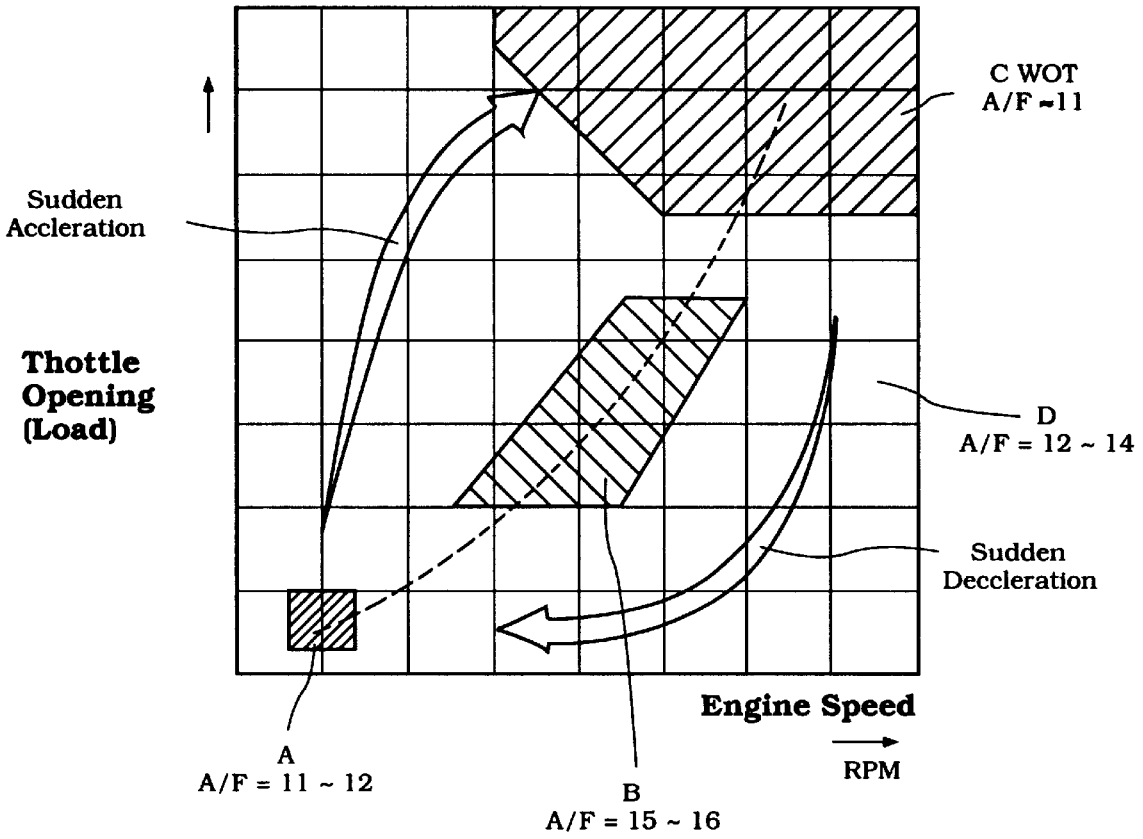
FIG. 5 is a map that shows the different control ranges that are employed in conjunction with the invention.

The basic control strategy for running under other than start up or warm up may be of any known type. For example only this may be to set various desired air fuel ratios depending on the engine running ranges. Examples of various operating ranges are shown in FIG. 5 and will now be described. FIG. 5 is a graphical view showing the determinations that are made in the ECU 68 to determine the engine operational range. Under light loads and speeds the mixture is kept rich and the air/fuel ratio is set so as to be in the range of about 11 to 12 to 1. This range is indicated by the reference character A.

In midrange conditions there is a control range indicated at B where the engine is operated in a lean burn condition and the mixture may be somewhat stratified. This range is indicated by the reference character B and in this range the air/fuel ratio is maintained in the range of about 15 to 16 to 1.

Under high load/high speed conditions which approaches wide open throttle, there is a third control range indicated at C where the mixture is run on the excessively rich side to protect the engine from damage. In this range, the air to fuel ratio is maintained about 11 to 1.

There is a remaining range outside of those noted which is indicated at D and in this range the mixture is kept on the weak side of rich, i.e., around 12 to 14 to 1.

There are also two other types of conditions which are indicated by the open arrows one of which represents sudden acceleration and the other of which indicates sudden deceleration. As aforenoted, these are typical of the normal feed back control ranges with which the invention may be employed.

As has been noted, this invention deals primarily with the mode of control during engine starting or engine warm-up. These conditions are sensed in a manner which will be described later. The basic strategy under start up or warm up is that in either or both of these conditions, the cylinder with which the oxygen sensor 75 is associated is operated at all times under a feedback control. However, this feedback control is not applied to the remaining cylinders. Rather, the amount of fuel supplied to these cylinders is adjusted by a fixed amount greater than the amount of incremental fuel added to the feedback controlled cylinder.

Figure 6:
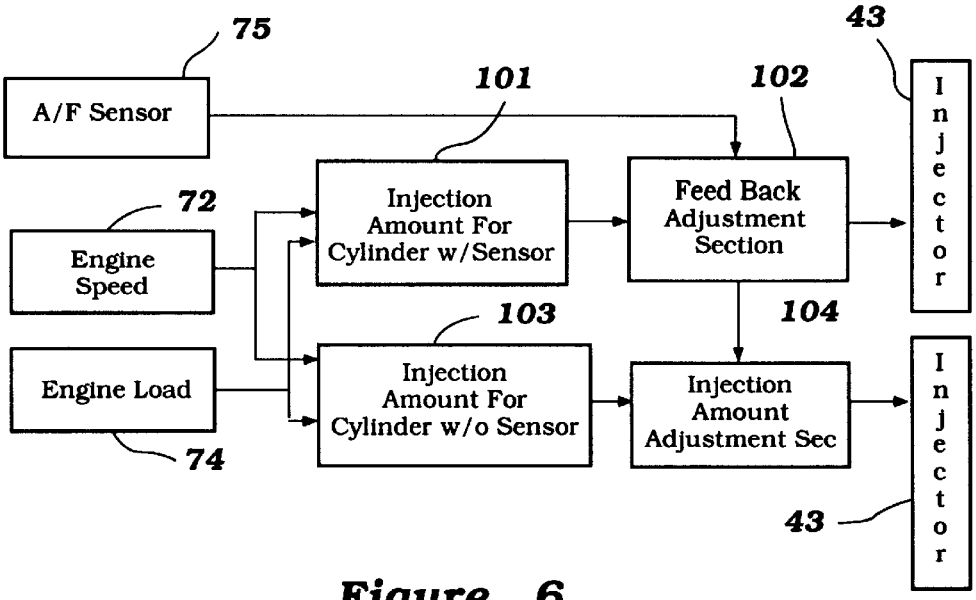
FIG. 6 is a block diagram showing the components associated with the start-up or warm-up control for the fuel injectors of the engine.

Thus, the system appears generally like that shown in FIG. 6 wherein the output from engine speed sensor, i.e., the crank angle sensor 72 and the engine load, as determined by the throttle position sensor 74, are output to a first control section 101 of the ECU 68 which is the section for feedback control of the cylinder with which the oxygen sensor 75 is associated. This is the number one cylinder on one cylinder bank as clearly seen in FIG. 1.

Figure 7:
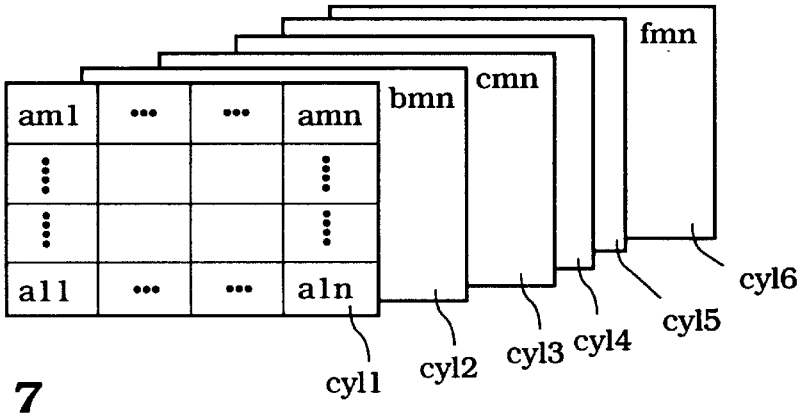
FIG. 7 is a map showing the basic fuel injection amount for each cylinder of the engine.

This control section 101 calculates a fuel injection amount from a basic map as seen in FIG. 7 based upon engine speed and throttle opening. Then, the output from the oxygen sensor 75 is transmitted along with this signal to a further control block 102 which makes the feedback control adjustment depending on the sensed deviation from the desired ratio and then supplies injection amount signals to the fuel injector 43 associated with this cylinder.

Another control block 103 of the ECU 68 is provided for each remaining cylinder. This receives the engine speed and engine load signal and looks up in a map as shown in FIG. 7 the amount of fuel for the respective cylinder from the fixed maps.

Figure 8:
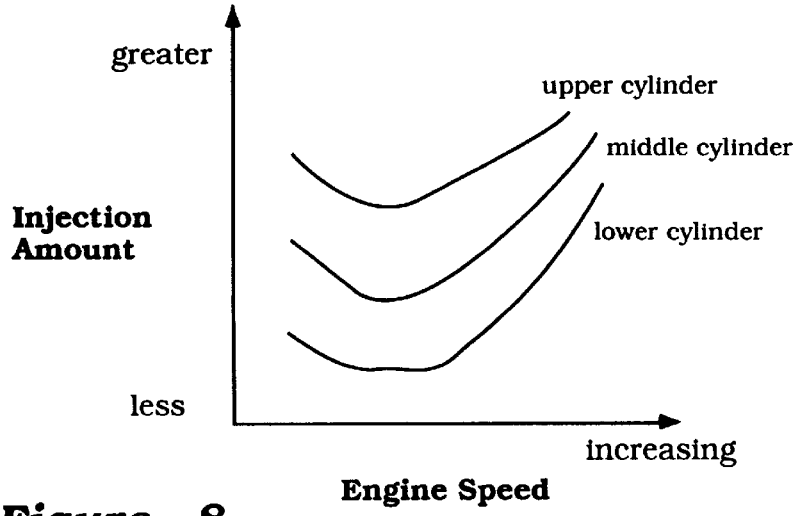
FIG. 8 is a graphical view showing the amount of fuel injected by each cylinder during the warm-up or starting mode depending upon the actual operating speed.

As seen in FIG. 8, the higher the cylinder in the engine, the greater the fuel that is supplied to it. This is because of the difference in length from the exhaust port of the cylinder to the end of the exhaust pipe which, with two-cycle engines, has a pronounced effect on the air-fuel ratio required for each cylinder to operate efficiently.

Figure 9:
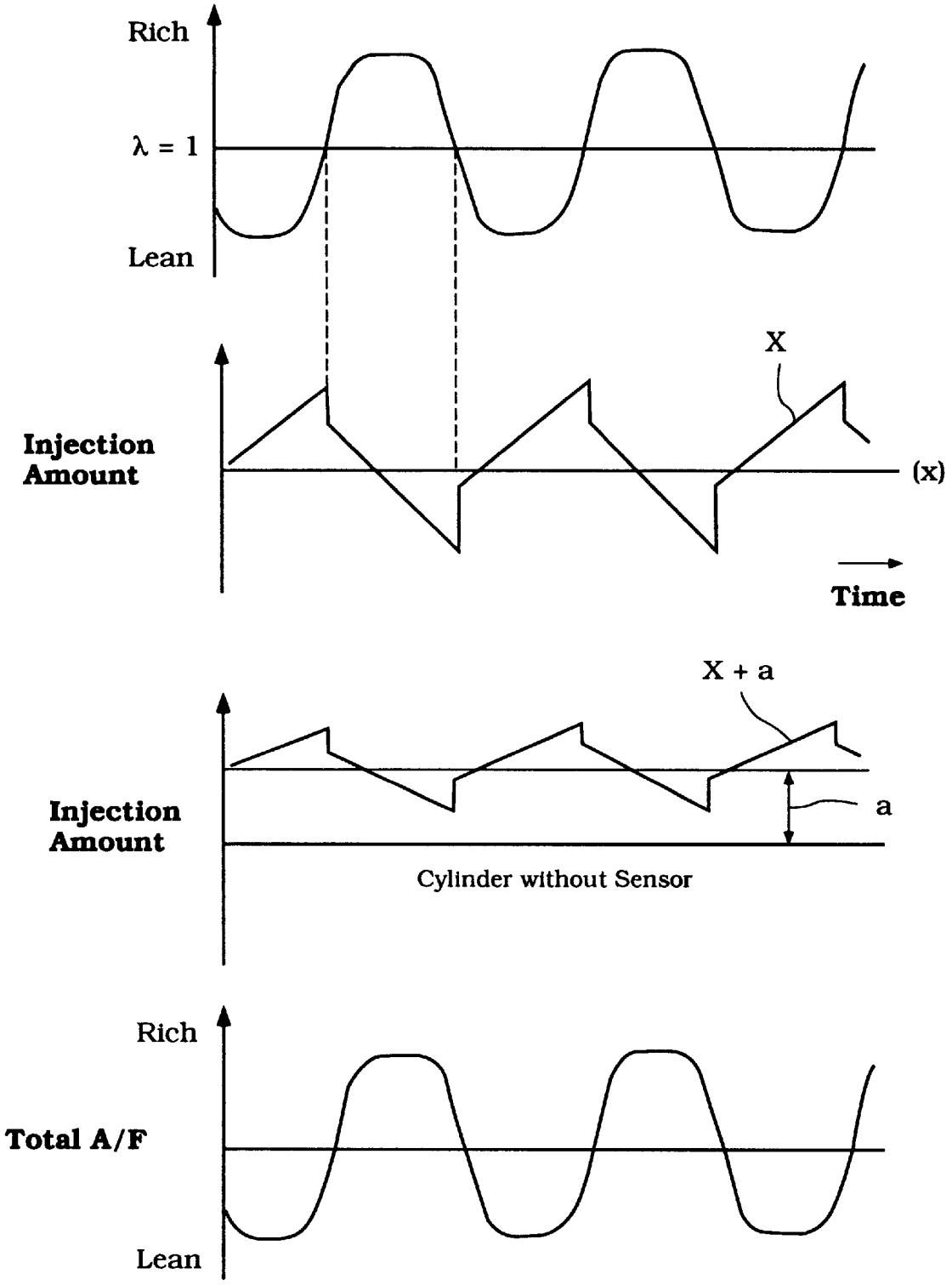
FIG. 9 is a graphical view showing, from top to bottom, the sensor output, the fuel injected amount for the cylinder having the feedback control during start-up or warm-up mode, the amount of fuel supplied to those cylinders not operated under feedback control and the overall engine mixture strength.

The output from the control block 103 is transmitted to a further control block 104 which makes an incremental adjustment in the amount of fuel supplied to the cylinder based upon the value X, i.e., the deviation from the desired air-fuel ratio as shown in FIG. 9. The same amount is applied to each cylinder based upon the output signal from the oxygen sensor 75.

As a result of utilizing this system, therefore, it is possible to maintain a lower overall fuel consumption for the engine and start-up and warm-up are facilitated. Switchover to a normal feedback mode and the manner of this control can be of any suitable manner.

Figure 10:
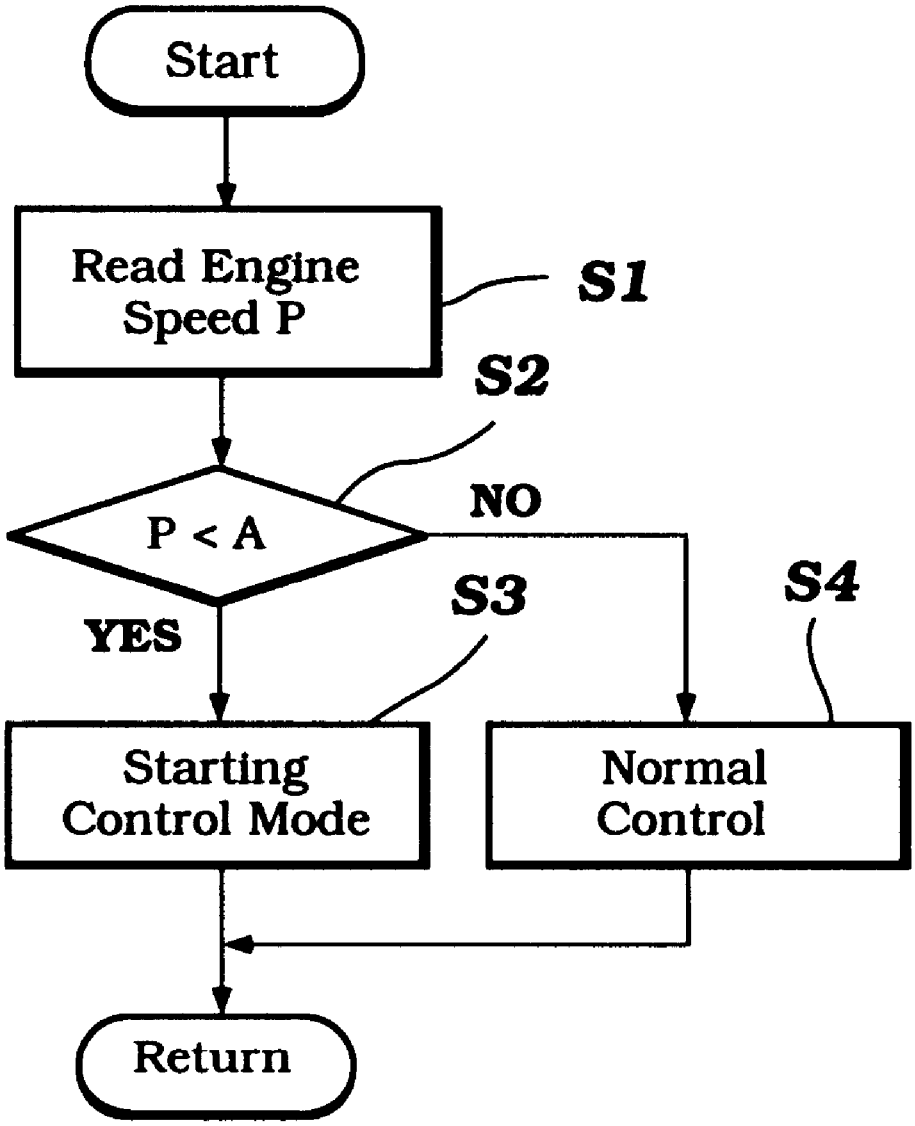
FIG. 10 is a graphical view showing the control routine utilized to determine when the engine is in the start-up mode.

FIG. 10 is a graphical view showing one way to determine if the engine is in a start-up mode. As seen in this figure, the program starts and then moves to the step S1 to read the engine speed "p". If engine speed is below a predetermined speed, indicated at "A", which is a speed lower than idle speed but higher than cranking speed, then it is assumed the engine is in a starting mode and the program moves to the step S3 to apply the start-up control routine already described. The program then repeats.

If, however, at the step S2, it is determined that the engine speed is greater than the predetermined speed A, then the program moves to step S4 to employ the standard feedback control routine, which, as has been noted, can be of any known type.

Rather than using engine speed, it is also possible to use engine temperature to determine if the engine is in a warm-up mode. If such a routine is followed, it appears quite similar to FIG. 10 but rather than reading engine speed and comparing it with a preset speed, engine temperature in a predetermined warm-up temperature is utilized.

The embodiments thus far described are all in connection with a two cycle engine. As mentioned earlier, however, the invention also can be utilized with four-cycle engines and such engine embodiment is shown in FIG. 11. The illustrated embodiment is of a V6 twin overhead cam shaft engine. The overhead cam shaft mechanism appears in this figure and is identified generally by the reference numeral 201. Since the invention can be practiced with any type of conventional four-cycle engine as well as any type of two cycle engine, further description of this embodiment is not believed to be necessary to permit those skilled in the art to practice the invention. Also, since primarily the same parameters are measured, the same sensor arrangements have also been illustrated in this figure. In view of the foregoing description, however, it is believed unnecessary to fully describe this embodiment since it is believed that those skilled in the art will literally understand how the invention can be practiced with four-cycle engines as well as two cycle engines.

Thus, from the foregoing description it should be readily apparent that the injection control strategy described is very effective in providing good engine starting and warm up along with rapid transition to full feedback control. Of course, the foregoing description is that of a preferred embodiment of the invention and various changes and modifications may be made without departing from the spirit and scope of the invention, as defined by the appended claims.

We claim:

1. An internal combustion engine having at least two combustion chambers, an air induction system for delivering an air charge to said combustion chambers, an exhaust system for discharging the burnt charge from said combustion chambers, a fuel injector is for each combustion chamber for injecting fuel into the air supplied by said induction system for burning in the respective of said combustion chamber, a combustion condition sensor associated with one of said combustion chambers and not for another of said combustion chambers for providing a signal indicative of the air fuel ratio in said one combustion chamber, a feedback control system for controlling the amount of fuel supplied by said fuel injectors to the respective of said combustion chambers, and means for sensing at least one of a starting and warm-up condition of said engine, said feedback control system providing feedback control only for said one combustion chamber when said one condition is sensed and controlling the amount of fuel supplied to the other of said combustion chambers by its fuel injector by adding a fixed incremental value of fuel to the adjusted amount of fuel injected to said one combustion chamber.

2. An internal combustion engine as set forth in claim 1 wherein engine starting is the condition sensed.

3. An internal combustion engine as set forth in claim 2 wherein engine starting is determined to exist if the engine speed is below a predetermined speed.

4. An internal combustion engine as set forth in claim 1 wherein engine warm up is the condition sensed.

5. An internal combustion engine as set forth in claim 4 wherein engine warm up is determined if the temperature is below a predetermined temperature.

6. An internal combustion engine as set forth in claim 4 wherein the routine is also followed if engine starting is sensed.

7. An internal combustion engine as set forth in claim 1 wherein each fuel injector injects fuel directly into its associated combustion chamber.

8. An internal combustion engine as set forth in claim 7 wherein the engine operates on a two cycle crankcase compression principle.

9. An internal combustion engine as set forth in claim 8 wherein the engine powers a marine propulsion device.

10. An internal combustion engine as set forth in claim 9 wherein the engine exhaust port delivers the exhaust gasses to the atmosphere through the body of water in which the marine propulsion device operates under at least some running conditions.

11. An internal combustion engine as set forth in claim 7 wherein the engine operates on a four cycle principle.

12. An internal combustion engine as set forth in claim 11 wherein the engine powers a marine propulsion device.

13. An internal combustion engine as set forth in claim 12 wherein the engine exhaust port delivers the exhaust gasses to the atmosphere through the body of water in which the marine propulsion device operates under at least some running conditions.

14. A method of operating an internal combustion engine having at least two combustion chambers, an air induction system for delivering an air charge to said combustion chambers, an exhaust system for discharging the burnt charge from said combustion chambers, a fuel injector is for each combustion chamber for injecting fuel into the air supplied by said induction system for burning in the respective of said combustion chamber, said method comprising the steps of sensing the air fuel ratio in only one combustion chamber, controlling the amount of fuel supplied by said fuel injectors to the respective of said combustion chambers, sensing at least one of a starting and warm-up condition of said engine, and providing feedback control only for said one combustion chamber when said one condition is sensed and controlling the amount of fuel supplied to the other of said combustion chambers by its fuel injector by adding a fixed incremental value of fuel to the adjusted amount of fuel injected to said one combustion chamber.

15. A method of operating an internal combustion engine as set forth in claim 14 wherein engine starting is the condition sensed.

16. A method of operating an internal combustion engine as set forth in claim 15 wherein engine starting is determined to exist if the engine speed is below a predetermined speed.

17. A method of operating an internal combustion engine as set forth in claim 14 wherein engine warm up is the condition sensed.

18. A method of operating an internal combustion engine as set forth in claim 17 wherein engine warm up is determined if the temperature is below a predetermined temperature.

19. A method of operating an internal combustion engine as set forth in claim 17 wherein the routine is also followed if engine starting is sensed.

20. A method of operating an internal combustion engine as set forth in claim 14 wherein each fuel injector injects fuel directly into its associated combustion chamber.

21. A method of operating an internal combustion engine as set forth in claim 20 wherein the engine operates on a two cycle crankcase compression principle.

22. A method of operating an internal combustion engine as set forth in claim 21 wherein the engine powers a marine propulsion device.

23. A method of operating an internal combustion engine as set forth in claim 22 wherein the engine exhaust port delivers the exhaust gasses to the atmosphere through the body of water in which the marine propulsion device operates under at least some running conditions.

24. A method of operating an internal combustion engine as set forth in claim 20 wherein the engine operates on a four cycle principle.

25. A method of operating an internal combustion engine as set forth in claim 24 wherein the engine powers a marine propulsion device.

26. A method of operating an internal combustion engine as set forth in claim 25 wherein the engine exhaust port delivers the exhaust gasses to the atmosphere through the body of water in which the marine propulsion device operates under at least some running conditions.

* * * * *